United States Patent [19]

Newman et al.

[11] 3,944,316

[45] Mar. 16, 1976

[54] ELECTRICAL CONNECTORS WITH KEYING MEANS

[76] Inventors: Albert P. Newman; Victor L. Arrighi, both of c/o Empire Products, Inc. 10540 Chester Road, Cincinnati, Ohio 45215

[22] Filed: Aug. 26, 1974

[21] Appl. No.: 500,327

[52] U.S. Cl. ..... 339/111; 200/51.09; 339/186 R

[51] Int. Cl.[2] ..... H01R 13/64

[58] Field of Search ..... 339/186 R, 186 M, 186 T, 339/184 R, 184 M, 111; 200/51.09

[56] References Cited

UNITED STATES PATENTS

| | | | |
|---|---|---|---|
| 1,689,495 | 10/1928 | McElroy | 200/51.09 |
| 2,986,612 | 5/1961 | Healy | 200/51.09 |
| 3,206,714 | 9/1965 | Kostich | 339/186 M |
| 3,325,771 | 6/1967 | Ruehlemann et al. | 339/184 M |
| 3,598,941 | 8/1971 | Nelson | 200/51.09 |
| 3,714,617 | 1/1973 | Bright et al. | 339/186 M |
| 3,843,854 | 10/1974 | Mori et al. | 200/51.09 |

FOREIGN PATENTS OR APPLICATIONS

| | | | |
|---|---|---|---|
| 616,941 | 1/1949 | United Kingdom | 339/184 M |

*Primary Examiner*—Gerald A. Dost
*Assistant Examiner*—Neil Abrams

[57] ABSTRACT

In an electrical connector assembly comprising a male connector and a mating female connector, both of which terminate at least one electrical cable, keying means in association with the male and female connectors enabling their mating and preventing their mating with similar connectors where such mating would be undesirable.

6 Claims, 12 Drawing Figures

ELECTRICAL CONNECTORS WITH KEYING MEANS

BACKGROUND OF THE INVENTION

1. Field of the Invention

The invention relates to electrical connectors used to terminate electrical cable lengths and by which the cables can be coupled, and more particularly to such connectors provided with keying means enabling them to be mated and preventing them from being mated with other similar connectors.

2. Description of the Prior Art

In many industrial applications, in manufacturing plants, building sites and the like, it is necessary to provide a plurality of connector assemblies for electrical cables. Generally, each connector assembly comprises a male connector and a female connector. One of the cable or cables of one of the connectors of each assembly is normally connected to a source of electrical power. The cable or cables of the other connector of that assembly is connected to a machine, device, vehicle or the like to be powered. The various machines, vehicles or the like to be energized will usually have different power requirements. It is therefore imperative that each male connector be properly mated with its intended female connector to prevent damage to the machine or vehicle being energized and injury to its operator.

In instances where the male and female connectors of the various connector assemblies are substantially identical, the prior art has met this problem by color coding the male and female connectors. While partially effective to solve the problem, color coding does not physically prevent the inadvertent mating of the wrong male and female connectors. Another prior art solution has been to provide different types of connectors for each connector assembly to physically prevent inadvertent incorrect coupling. While effective, this requires the manufacturer or contractor to maintain a large inventory of different types of connectors which is both difficult and expensive.

In accordance with the present invention, all of the male and female connectors of the various connector assemblies may be substanially identical. However, the male and female connectors of each connector assembly are provided with keying means which enable their mating, but which prevents the mating of the male or female connector of that assembly with a male or female connector of any of the other connector assemblies. As will be described hereinafter, the orientation of the keying means may be determined at the time the connectors are manufactured, or the keying means may be made in such a way that the user of the connectors may orient them to suit his particular needs, requiring the stocking of only one type of male connector and one type of female connector. As a further visual indication, it is within the scope of the present invention to color code the connectors in addition to the provision of the keying means.

The keying means of the present invention is applicable to various types of connector means. For purposes of an exemplary showing, it will be taught with respect to its application to connectors of the general class taught in U.S. Pat. Nos. 3,662,296 and 3,784,964.

SUMMARY OF THE INVENTION

The present invention provides keying means for an electrical connector assembly of the type comprising a male connector with at least one male contact and a mating female connector with at least one female contact, both of which terminate at least one electric cable. The keying means, in association with the male and female connectors, enables their mating if they are properly to be mated and effectively prevents the coupling of the male and female connectors of the assembly with the female and male connectors, respectively, of other connector assemblies where such coupling would be undesirable or harmful.

The keying means comprises a first element mounted on one of the male and female connectors and providing a forwardly extending keying pin with its axis parallel to the axis of the contact of that connector. A second element is mounted on the other of the male and female connectors and provides a keyhole or socket configured to accept the keying pin, the axis of the socket being parallel to the contact of that connector supporting the socket. The element carrying the keying pin and the element containing the keyhole or socket are capable of being mounted on their respective connectors in various rotative positions about their own longitudinal axes. The keying pin will enter the keyhole or socket, permitting coupling of the male and female connectors only if the element bearing the keying pin and the element having the keyhole or socket are in properly corresponding rotative positions.

In addition to their purposes as safety means to prevent the improper coupling of connectors, the keying means may also serve as a set of electrical contacts as a part of a grounding circuit or other circuit. Furthermore, that element having the keyhold or socket may have in association with it a series connected circuit-interrupting safety switch activated by the keying pin, when fully seated therein. The construction of the parts is preferably such that the safety switch will be deenergized prior to the complete separation of the male and female contacts of the connectors and the safety switch will be energized after entrance of the male contact within the female contact when the connectors are coupled. This will prevent arcing across the male-female contacts.

BRIEF DESCRIPTION OF THE DRAWINGS

FIG. 11 is a cross-sectional view illustrating the connector assembly of the present invention with the male and female connectors of FIGS. 1 and 2 in coupled condition.

FIG. 12 is a semi-diagrammatic illustration of the various positions of the keying pin and the keyhole or socket.

DESCRIPTION OF THE PREFERRED EMBODIMENTS

The keying means of the present invention is applicable to various types of connectors for electric cables such as those for example, taught in the above mentioned U.S. Pat. Nos. 3,662,296 and 3,784,964. The number of male and female contacts carried by the connectors does not constitute a limitation on the present invention.

Figure 1:
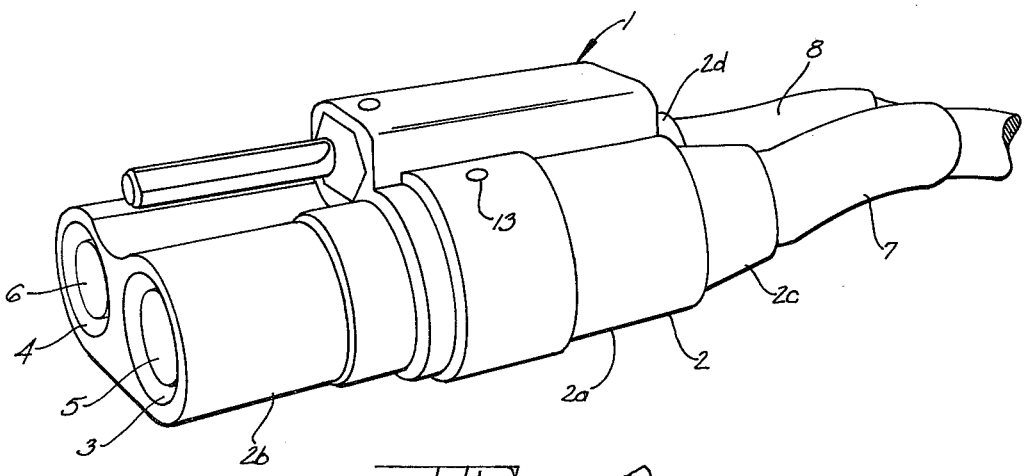
FIG. 1 is a perspective view illustrating a male connector provided with the keying pin of the present invention.
Figure 2:
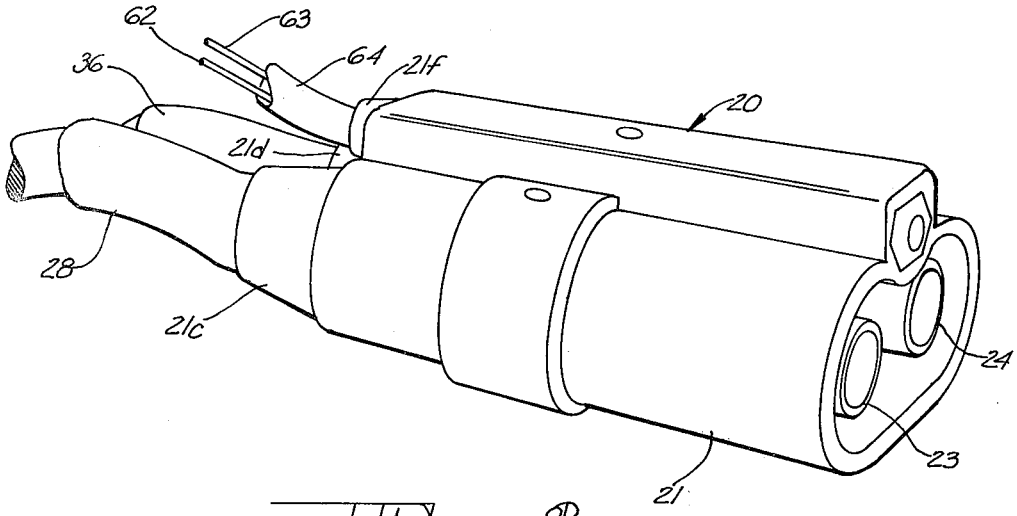
FIG. 2 is a perspective view of a female connector provided with an element bearing the keyhole or socket portion of the keying means of the present invention.
Figure 3:
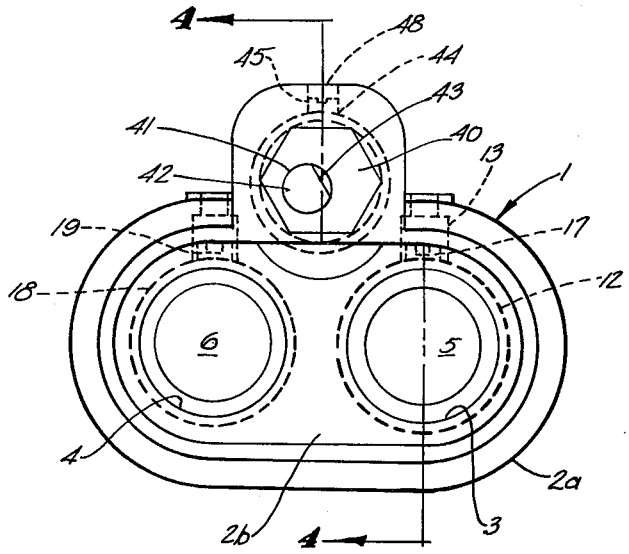
FIG. 3 is a front elevational view of the male connector of FIG. 1.
Figure 4:
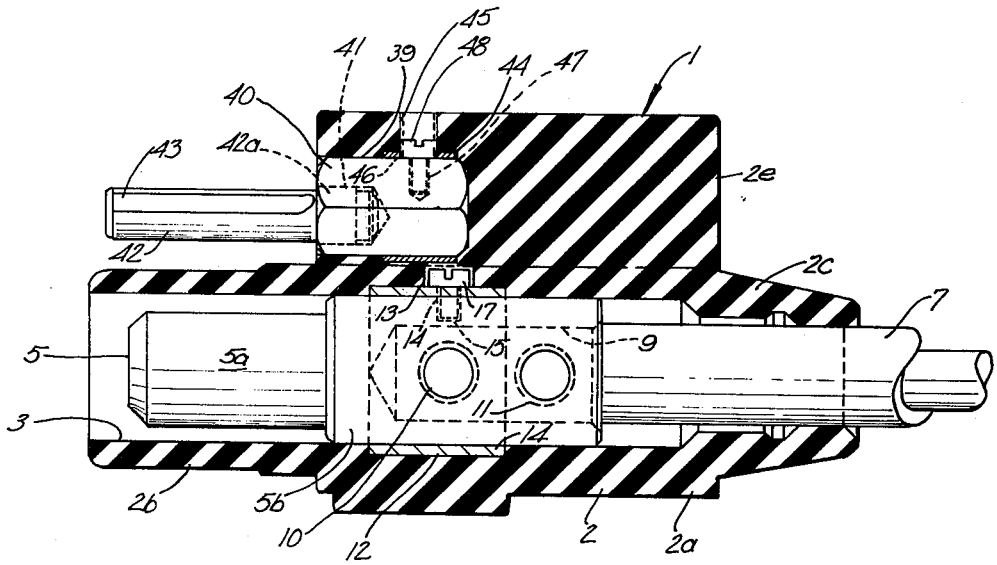
FIG. 4 is a cross-sectional view taken along section line 4—4 of FIG. 3.

Exemplary male and female connectors are illustrated in FIGS. 1 and 2. Referring first to FIGS. 1, 3 and 4, wherein like parts are given like index numerals, the male connector is generally indicated at 1. The connector comprises an insulative housing 2, preformed of flexible insulating material such as neoprene or the like. The housing 2 has a main body portion 2*a*, a forward extension 2*b* and a pair of rear bosses 2*c* and 2*d* (see FIG. 1).

A pair of longitudinal perforations 3 and 4 extend through the housing. These perforations are substantially identical and perforation 3 is clearly shown in FIG. 4. Within perforations 3 and 4 (spaced slightly inwardly from the forward end of body portion 2*b*) there are a pair of male contacts 5 and 6. These contacts are connected, respectively, to cables 7 and 8 (see FIG. 1). The contacts 5 and 6 and their connection to their respective cables 7 and 8 are substantially identical. FIG. 4 clearly illustrates contact 5 and its cable 7.

The contact 5 has a forward portion 5*a* adapted to be received within the corresponding female contact in the female connector, as will be explained hereinafter. The contact 5 has an enlarged portion 5*b* having an axial perforation 9 extending from the rearward end thereof. The perforation 9 is so sized as to receive the end of cable 7, stripped of its insulation, and held within the perforation 9 by a pair of set screws 10 and 11.

The perforation 3 housing the contact 5 has permanently molded therein a collar 12. A series of coaxial bores are provided in the housing 2 as at 13, in the collar 12 as at 14 and in the enlarged portion 5*b* of connector 5 as at 15. The hole 15 is threaded and is adapted to be threadedly engaged by a screw 17 extending through housing perforation 13, collar perforations 14 and into the contact perforation 15. In this way, the contact 5 is firmly affixed within the housing 2. As will be evident from FIG. 3, the contact 6 is similarly provided with a collar 18 and is held within the housing 2 by a screw 19. While not shown, both of the male contacts 5 and 6 may be provided with a longitudinal slot and a protective cap of non-conductive material at their forward ends, as is taught in U.S. Pat. No. 3,662,296.

Figure 5:
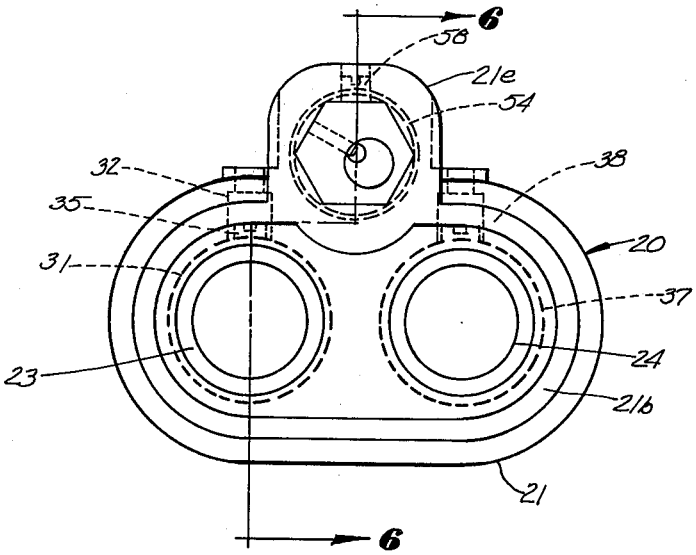
FIG. 5 is a front elevational view of the female connector of FIG. 2.
Figure 6:
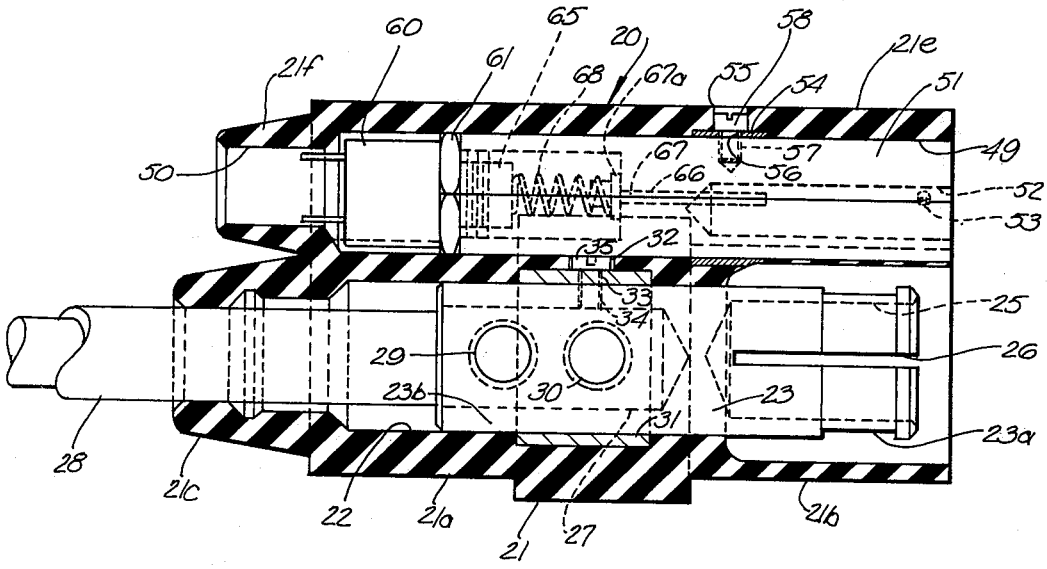
FIG. 6 is a cross-sectional view taken along the section line 6—6 of FIG. 5.

Turning for the moment to FIGS. 2, 5 and 6, the female connector is generally indicated at 20 and comprises an insulative housing 21 which may be made of the same material as the insulative housing 2 of the main connector. The housing 21 has a main body portion 21*a*, a forward hollow extension 21*b* and a pair of rear bosses 21*c* and 21*d* (see FIG. 2).

The main body portion 21*a* of the insulative housing 21 has a pair of perforations extending therethrough, each perforation also extending through one of the bosses 21*c* and 21*d*. These perforations are substantially identical and one of them is shown at 22 in FIG. 6. The female connector is provided with a pair of female contacts 23 and 24. Each of these female contacts is mounted in one of the above mentioned perforations through the body portion 21*a* of the housing 21 with their forward ends located in the hollow forward extension 21*b*, slightly inset from the front thereof. The female contacts 23 and 24 are substantially identical and a description of contact 23 with respect to FIG. 6 should suffice for both of them. Turning to FIG. 6, the female contact 23 has a forward portion 23*a* provided with an axial bore 25 adapted to receive the forward end 5*a* of male contact 5. This portion 23*a* of the female contact 23 may be provided with a plurality of longitudinal slots, one of which is shown at 26. This permits slight expansion of this portion of the female contact enabling the fit between it and male contact portion 5*a* to be tight to assure a firm surface-to-surface contact between the two.

Female contact 23 has a main body portion 23*b* having an axial bore 27 extending from the rearward end thereof. The bore 27 is similar to the bore 19 in the male contact 5 and is adapted to receive the stripped end of a cable 28. The cable end is firmly held within the bore 27 by a pair of set screws 29 and 30.

In a manner similar to that described with respect to male contact 5, the perforation 22 in the housing of female connector 1 may have molded therein a collar 31 through which the body portion 23*b* of the female contact 23 extends. The housing 21, collar 31 and female contact body portion 23*b* have coaxial holes 32, 33 and 34, respectively therein. The hole 34 in the portion 23*a* of female contact 23 is threaded and is adapted to be threadedly engaged by a screw 35 similar to screw 17 of FIG. 4.

The female contact 24 will be connected to a cable 36 in the same manner described with respect to the connection of female contact 23 and cable 28. Similarly, as is indicated in FIG. 5, the female contact 24 is firmly held within the housing 21 by means of a collar 37 identical to the collar 31. A screw 38 passes through the housing, collar and into the female contact 24 in the same manner described with respect to screw 35.

Having described the basic structure of the male connector 1 and female connector 2, attention can now be turned to the keying means of the present invention. Basically, the keying means comprises an element bearing a keying pin affixed to one of the connectors and an element bearing a keyhole or socket to receive the keying pin mounted on the other connector. The keying pin bearing element may be mounted on either one of the male and female connectors with the socket-bearing element mounted on the other. For purposes of an exemplary showing, the keying pin bearing element is shown in the figures mounted upon the male connector.

Reference is first made to FIGS. 1, 3, 4 and 7 wherein the keying pin bearing element is shown. Again, like parts have been given like index numerals.

The housing 2 of the main connector has on its upper surface, running centrally and longitudinally thereof, an upward extension 2*e*. The upward extension may constitute an integral part of the housing and is made of the same insulative material. The forward end of the upward extension has a longitudinal perforation 39 of hexagonal cross section, adapted to receive the element bearing the keying pin.

Figure 7:
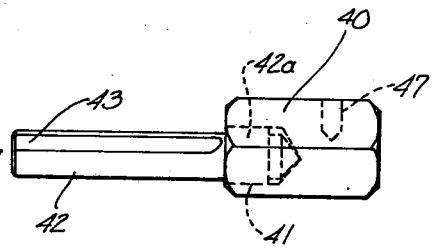
FIG. 7 is a side elevational view of the keying pin and its mounting element.

Referring to FIG. 7, the element bearing the keying pin comprises a hexagonal nut 40 of such size as to be just nicely received within the perforation 39 in the upward extension 2*e*. At its forward end, and displaced radially from its axial center, the nut 40 has a perforation 41. The axial displacement of the perforation 41 is most clearly shown in FIG. 3.

The keying pin 42 comprises an elongated member having, for the majority of its length, a flat 43 formed thereon. At one end, the pin 42 has an enlarged diameter portion 42*a*. This portion is adapted to be received in and affixed in the perforation 41 of hexagonal nut 40. The attachment of keying pin 43 to hexagonal nut 40 may be accomplished by a force fit. To this end, the large diameter portion 42*a* of the keying pin may be knurled or the like. Alternatively, the keying pin may be affixed to the hexagonal nut by welding, brazing, adhesive means or the like.

As is shown in FIGS. 3 and 4, the upper extension 2*e* has a collar 44 molded therein. The upper extension has a perforation 45 which is coaxial with a perforation 46 through collar 44 and a threaded perforation 47 extending into the hexagonal nut 40. In this manner, the hexagonal nut is firmly held in the perforation 39 in the upward extension 2e by a screw 48 extending through the perforation 45 in the upper extension, the perforation 46 in the collar 44 and threadedly engaged in the perforation 47 in the hexagonal nut. Since the hexagonal nut 40 is firmly affixed within the upper extension 2*e*, the keying pin 43 will be held firmly in place, extending forwardly of the upper extension 2*e* with its axis parallel to the axes of male contacts 5 and 6.

Figure 8:
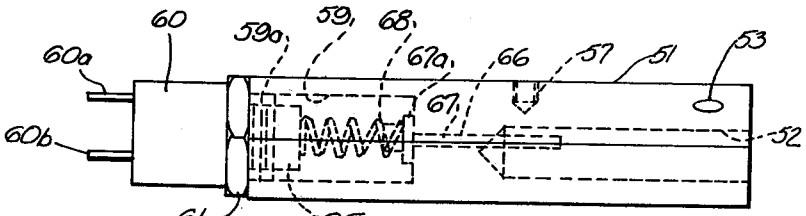
FIG. 8 is a side elevational view of a keyhole or socket bearing element provided with a pin-actuated safety switch.
Figure 10:
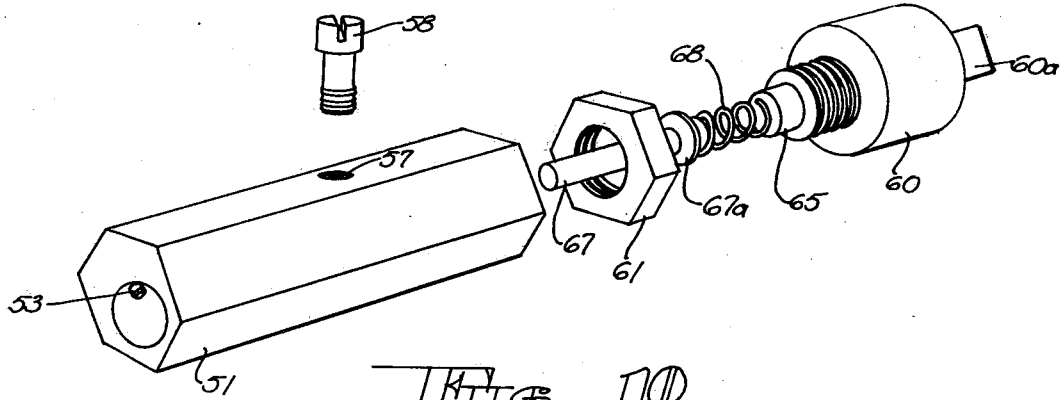
FIG. 10 is a perspective, exploded view of the structure of FIG. 8.
Figure 9:
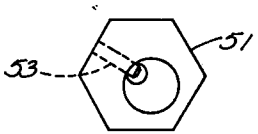
FIG. 9 is an end elevational view of the keyhole or socket bearing element of FIG. 8, as seen from the right in that figure.
Figures 7, 7A:
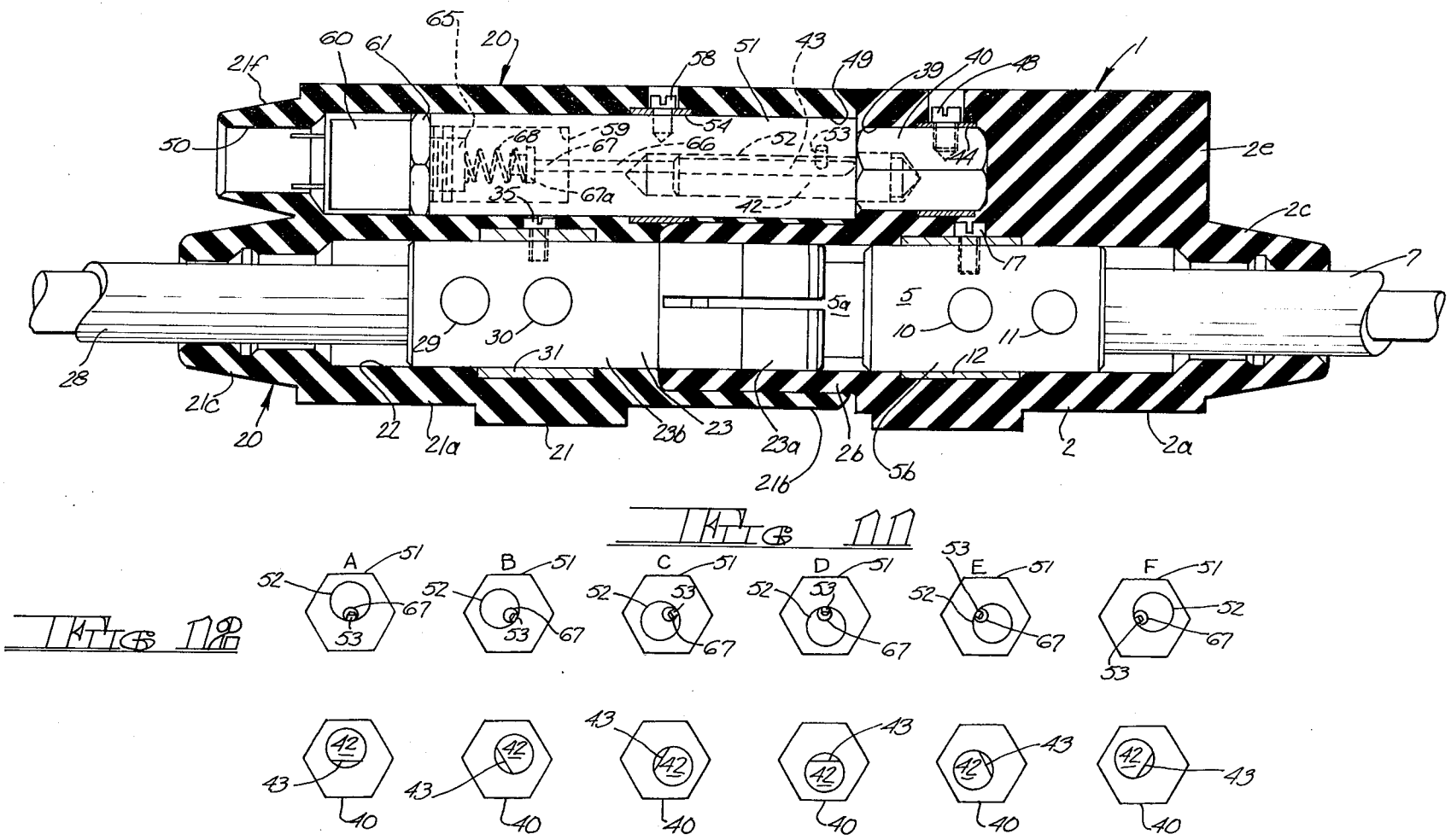

For purposes of an exemplary showing, the keying element bearing the keyhole or socket to receive keying pin 43 is shown mounted upon the female connector in FIGS. 2, 5 and 6. The element itself is illustrated in FIGS. 8, 9 and 10. Turning first to FIGS. 5 and 6, it will be noted that the insulative housing 21 of female connector 20 has an upward extension 21*e* running centrally and longitudinally of the top thereof. As in the case of upward extension 2e of the male connector, the upward extension 21*e* may be an integral part of the insulative housing 21, made of the same insulative material. The upward extension 21*e* has a boss 21*f* at the rearward end thereof. A longitudinal perforation 49 extends the length of the main portion of upward extension 21*e* and is of hexagonal cross section. The perforation 49 opens into a perforation 50 of circular cross section in boss 21*f*.

The element bearing the keyhole or socket is most clearly shown in FIGS. 8 through 10, wherein like parts are given like index numerals. This element is indicated at 51 and is elongated, having a hexagonal cross sectional configuration. The hexagonal cross sectional configuration may be substantially identical to that of nut 40 in FIG. 7. At its forward end, the element 51 is provided with a longitudinal perforation 52 which, as may be noted from FIGS. 9 and 10, is radially offset from the axial center of element 51. A stud 53 extends through a hole in the element 51 with its forwardmost end protruding into the axial perforation 52. The hole 52 is adapted to receive the keying pin 42 and the stud 53 will be accommodated by flat 43 on keying pin 42.

Returning to FIGS. 5 and 6, it will be noted that a collar 54 is permanently molded into the perforation 49 of upward extension 21e in the same manner described with respect to collar 44 in FIG. 4. Coaxial holes pass through the upper extension 21e as at 55, the collar 54 as at 56 and into the element 51 as at 57. The hole 57 in element 51 is threaded and is adapted to be threadedly engaged by a screw 58 passing through perforations 55 and 56 and into perforation 57. In this manner, the elongated element 51 having the keyhole or socket 52 is firmly mounted in the perforation 49 of upward extension 21*e* with the axis of socket 52 being parallel to the axis of female contacts 23 and 24.

Returning to FIGS. 8 through 10, it will be noted that the elongated element 51 has, at its rearward end, an axial hole 59. The initial portion of the hole is threaded as at 59a and is adapted to receive in threaded engagement the forward end of a switch 60. The switch 60 is of conventional design well known in the art and may be readily selected by one skilled in the art to have those specifications required for its intended purpose. For purposes of an exemplary showing, the switch 60 may be considered to be a series connected current interrupting safety switch which will permit the passage of current through the male and female contacts only when the safety switch is in its "closed" position. Threadedly engaged upon the forward end of switch 60, between the body of the switch and the rearward end of elongated element 51 there is a nut 61 by which the position of the switch may be axially adjusted with respect to the elongated element 51. Leads from the switch may be connected to switch contacts 60*a* and 60*b*. Such leads are shown at 62 and 63 in the form of a cable 64 extending rearwardly of the boss 21*f* in FIG. 2.

The switch 60 has a push button actuator 65. Between hole 59 and keyhole or socket 52 there extends a perforation 66 in which a plunger 67 is slidably located. The rearward end 67*a* of the plunger is engaged by one end of a compression spring 68. The other end of spring 68 engages push button 65 of switch 60. It will be understood from FIGS. 8 and 10 that axial shifting of plunger 67 will result in the shifting of push button 65 between closed and "open" positions.

In FIG. 11 the male connector of FIGS. 1, 3 and 4 is shown in its coupled position with the female connector of FIGS. 2, 5 and 6. In FIG. 11, like parts have been given the same index numerals as in the previously described figures. It will be noted that when the connectors 1 and 20 are fully mated, the forward extension portion 2*b* of the male connector insulative housing 2 is fully received within the hollow forward extension 21*b* of the female connector. The male contacts 5 and 6 are received within female contacts 23 and 24, respectively. The clearance between the forward end 5*a* of male contact 5 and the perforation 3 within which the forward end is located is such as to just nicely receive the forward end 23*a* of female contact 23. The same is, of course, true of male and female contacts 6 and 24.

When the connectors 1 and 20 are fully mated, the forward face of upward extension 2*e* of the male connector and the forward face of upper extension 21*e* of the female connector are in abutment. As a consequence, all of the electrical contacts, as well as the keying means, are fully enclosed by the connector housings 2 and 21.

FIGS. 6 and 8 illustrate the element 51 containing the keyhole or socket 52 with switch 60, push button 65, spring 68 and plunger 76 in that position they would normally assume when the male and female connectors are disengaged. The push button 65 of switch 60 is in its forwardmost or open position, switch 60 being a normally open-type switch. Similarly, by virtue of spring 68, plunger 67 is in its forwardmost position.

In FIG. 11, wherein the male connector 1 and female connector 2 are fully coupled, it will be noted that the keying pin 42 has shifted plunger 67 to its rearwardmost position. Through the agency of spring 68, push button 65 of switch 60 has been depressed to its closed position, thus completing the circuit and permitting current to flow through the cables and male and female connectors.

It will be evident from FIG. 11 that spring 68 is not fully collapsed when switch 60 is in its closed mode. This allows for over-travel and assures that the connectors 1 and 20 can be fully coupled.

In a comparison of FIGS. 6 and 11, it will be evident that upon the mating of connectors 1 and 20 the keying pin 42 will shift the push button 65 of switch 60 to its closed position after male contacts 5 and 6 have been at least partially engaged in female contacts 23 and 24, respectively. Similarly, during disengagement of the male and female connectors 1 and 20, the keying pin 42 will permit the push button 65 of switch 60 to reach its open position prior to complete disengagement of male contacts 5 and 6 from female contacts 23 and 24, respectively. This is an additional safety feature and prevents arching across the male and female contacts.

FIGS. 12 A through F diagrammatically illustrate the various rotative positions about its own axis that the element 51 can assume in the perforation 49 of the upstanding extension 21*f* on the female connector. FIGS. 12 A through F also diagrammatically illustrate the corresponding rotative position about its own axis that the nut 40 must assume in the perforation 39 of upward extension 2*e* on the male connector, if the male and female connectors are to be coupled. It will be understood that if the element 51 and nut 40 are not in the corresponding positions illustrated, the male and female connectors cannot be mated. Normally, the male and female connectors will be provided by the manufacturer as a mating set. It would be within the scope of the present invention, however, to provide the element 51 with a threaded perforation 57 in each of its peripheral faces and to provide the nut 40 with a threaded perforation 47 in each of its faces so that the user of the male and female connector assembly could arrange elements 51 and 40 to suit his particular purposes, it being necessary to stock only one type of male connector 1 and one type of female connector 2. In FIGS. 1 through 11, the nut 40 and element 51 are illustrated in the corresponding positions demonstrated in FIG. 12E.

While, in the figures thus far described, the element 51 has been shown to contain a safety-enabling switch, it will be understood that the switch 60 may be used to perform any other desired function. On the other hand, the keying means of the present invention may be used as an additional set of contacts. In such an instance, the plunger 67, spring 68 and switch 60 would be eliminated and the rearward end of element 51 would be connected to conductor means in any appropriate manner, as for example, in the manner described with respect to male contacts 5 and 6 and female contacts 23 and 24. Similarly, nut 40 would have an appropriate conductor affixed to its rearward end, again, in any appropriate manner.

Figure 13:
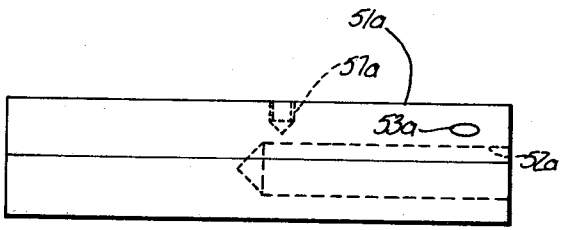
FIG. 13 is a side elevational view of another embodiment of a keyhole or socket bearing element.

In some instances, however, it may be desired that the keying means serve simply to insure that only desired male and female connectors be coupled. In this instance, the element 51 of FIG. 8 may be replaced by the element 51*a* of FIG. 13. The element 51*a* is substantially identical to the element 51 except for the elimination of perforation 66, plunger 67, spring 68, switch 60 and perforation 59. The element 51 has a keyhole or socket 52*a* identical to socket 52, a stud 53*a* identical to stud 53 and a threaded perforation 57*a* identical to threaded perforation 57 of element 51 and serving the same purpose.

Modifications may be made in the invention without departing from the spirit of it. For example, as mentioned above, as an additional safety feature the male and female connectors may be color coded, as is well known in the art.

In the particular embodiments illustrated, the element 51 and the nut 40 are shown as having a hexagonal peripheral configuration. This permits six optional corresponding positions to be assumed by the elements 51 and 40, as illustrated in FIG. 12. It will be understood by one skilled in the art that nut 40 and element 51 may be provided with other cross sectional configurations and provided with a fewer or a greater number of corresponding positions.

The various screw means 17, 19, 35, 38, 48 and 58 may be produced with insulative head means of the type described in U.S. Pat. No. 3,784,964.

Finally, the switch 60 may be used to serve any desired purpose and may be of any type required to accomplish that purpose.

We claim:

1. In an electrical connector assembly comprising a male connector with at least one male contact and a female connector with at least one female contact, said male and female connectors each terminating at least one electric cable and being adapted to be mated with said at least one male contact in engagement with said at least one female contact, the improvement comprising keying means in association with said male and female connectors enabling the mating of said male and female connectors with each other and preventing the mating of said male and female connectors with other similar female and male connectors and an electrical switch in association with said keying means, said keying means comprising a keying pin and mounting means therefor and an elongated member having a socket adapted to receive said keying pin, said mounting means for said keying pin comprising an elongated body, the longitudinal axis of said keying pin being parallel to and radially offset with respect to the longitudinal axis of said body, the longitudinal axis of said socket being parallel to and radially offset with respect to the longitudinal axis of said elongated member, said keying pin and said mounting means therefor being affixed to one of said male and female connectors with the axis of said keying pin being parallel to the axis of said at least one contact of said one of said male and female connectors, said elongated socket-bearing member being affixed to the other said male and female connectors with the axis of said socket being parallel to the axis of said at least one contact of said other of said male and female connectors, said mounting means for said keying pin being of hexagonal transverse cross section, said elongated socket-bearing member being of hexagonal transverse cross section, said keying pin mounting means being affixable to its respective connector in any one of six rotative positions about its longitudinal axis, said socket-bearing member also being affixable to its respective connector in any one of six corresponding rotative positions about its longitudinal axis, said radial offsets of said socket and said keying pin corresponding and said keying pin and mounting means therefor and said elongated socket-bearing element being so oriented on their respective connectors that said keying pin is receivable within said socket enabling mating of said male and female connectors and their respective male and female contacts, said switch mounted within said elongated socket-bearing member and means in association with said switch whereby said keying pin will activate said switch upon complete mating of said connectors and will deactivate siad switch when said connectors are disengaged.

2. The structure claimed in claim 1 including a stud extending transversely of and partially into said socket, said keying pin having a longitudinal flat to accommodate said stud.

3. The structure claimed in claim 1 wherein each of said connectors comprises an insulative housing surrounding said contacts thereof, said housing of each of said connectors having an extension thereon with a hexagonal hole adapted to receive its respective one of said socket-bearing member and said keying pin mounting means and means to maintain each of said socket-bearing member and said keying pin mounting means within its respective hexagonal hole.

4. The structure claimed in claim 1 wherein said socket in said socket-bearing member extends inwardly from one end of said member, the other end of said member having a hole therein extending toward said socket, a passage connecting said hole and said socket, a push button switch located within said hole with said push button facing said passage, a plunger mounted in and longitudinally slidable in said passage, a compression spring operatively connecting one end of said plunger to said push button, the other end of said plunger extending into said socket, said plunger being shiftable between a first position wherein said push button is depressed closing said switch and a second position therein said push button is extended opening said switch, said plunger being shifted to said first position by said keying pin upon complete mating of said connectors and said plunger being shifted to said second position by said spring when said connectors are disengaged.

5. The structure claimed in claim 4 wherein said keying pin and said plunger are so sized as to shift said plunger to said first position after said male contact enters said female contact upon the mating of said connectors and to shift said plunger to said second position prior to complete removal of said male contact from said female contact upon disengagement of said connectors.

6. The structure claimed in claim 5 wherein said push button switch is a series connected current interrupting safety switch such that when said plunger is shifted to said first position by said keying pin upon complete mating of said connector assembly and said safety switch is closed current will flow through said connector assembly and when said plunger is shifted to said second position by said spring while said connectors are disengaged and said safety switch is open any flow of current through said connector assembly will be interrupted.

* * * * *